US005695173A

United States Patent [19]

Ochoa et al.

[11] Patent Number: 5,695,173

[45] Date of Patent: Dec. 9, 1997

[54] SCISSORS LIFT PLATFORM WITH ELECTRONIC CONTROL

[76] Inventors: Arturo Valencia Ochoa; Jaime Antonio Uribe Uribe, both of KM. 9.6 Carrt. Constitucion a S. Luis Potosi, Industrial Zone B. Juarez, Queretaro, Qro., Mexico

[21] Appl. No.: 584,540

[22] Filed: Jan. 11, 1996

[51] Int. Cl.[6] ..... B66F 3/22

[52] U.S. Cl. ..... 254/122; 254/9 C; 254/10 C

[58] Field of Search ..... 254/10 C, 8 C, 254/9 C, 122

[56] References Cited

U.S. PATENT DOCUMENTS

| | | | |
|---|---|---|---|
| 2,829,863 | 4/1958 | Gibson | 254/8 C |
| 3,991,857 | 11/1976 | Wolk et al. | 254/122 |
| 4,511,110 | 4/1985 | Möller | 248/421 |
| 4,526,346 | 7/1985 | Galloway et al. | 254/122 |
| 4,545,017 | 10/1985 | Richardson | 254/276 |
| 4,558,648 | 12/1985 | Franklin et al. | 108/147 |
| 4,683,990 | 8/1987 | Wright | 187/134 |
| 4,690,606 | 9/1987 | Ross | 254/9 C |
| 4,712,653 | 12/1987 | Franklin et al. | 187/18 |
| 4,726,730 | 2/1988 | McConnell | 254/122 |
| 4,741,512 | 5/1988 | Elkuch et al. | 254/9 C |
| 4,930,598 | 6/1990 | Murrill et al. | 182/63 |
| 4,979,592 | 12/1990 | Isogai | 254/122 |
| 5,156,355 | 10/1992 | Wadle | 242/86.5 R |
| 5,297,916 | 3/1994 | Fujikawa et al. | 254/122 |

*Primary Examiner*—Timothy V. Eley
*Assistant Examiner*—Lee Wilson
*Attorney, Agent, or Firm*—Locke Purnell; Rain Harrell

[57] ABSTRACT

A lift platform sustained through a double system of support scissors in its lower part, which offers the mechanical upward and downward motion in a vertical plane and on a base frame, which in its turn is activated by a hydraulic mechanism. The lift platform is characterized because it also includes a hydraulic unit which operates electronically to automatically control the desired position in its upward or downward motion originated by the movement of the mobile arms of the scissors on a track in the horizontal plane.

3 Claims, 3 Drawing Sheets

SCISSORS LIFT PLATFORM WITH ELECTRONIC CONTROL

TECHNICAL FIELD OF THE INVENTION

The present invention relates generally to a lift platform having an electronic control system. Specifically, the lift platform is sustained through a double system of support scissors in its lower part.

BACKGROUND OF THE INVENTION

Different types of lift platforms are generally known as lift tables through scissors arms mechanism. The U.S. Pat. No. 4,930,598 presents a scissors table integrated by chassis, wheels and a platform connected through one or several combination of scissors arms in which each combination of scissors arms includes an arm center and two external supports pivotally connected to its longitudinal midpoints; however, this system does not include an electronic automatic control. The U.S. Pat. No. 4,712,653 relates to a recycle energy elevator (gas cylinder), a platform, base and a pair of scissors joints, each joint having a first and second scissors legs in order to obtain a translation movement. Although this invention presents a hydraulic movement through the gas cylinder, it does not have an electronic control and uses more than a pair of scissors. The U.S. Pat. No. 4,558,648 operates practically in the same way as the aforementioned patent, i.e. it uses a hydraulic cylinder as lift activator and it also lacks the electronic control for the lifting of the platform. Finally, the U.S. Pat. No. 4,511,110 relates to a scissors lift table which presents the drawback that it includes more than a pair of scissors for its vertical movement. In our case, the scissors system has a total importance within the equipment and has only a pair of scissors, which operate through an electronic control especially designed to control the elevation movement of the table at the desired height, and practically instantaneously.

SUMMARY OF THE INVENTION

The scissors lift platform, object of the present invention, includes the following elements: in the lower part of the platform there is a system of a pair of coupled scissors which offers the upward and downward motions in a vertical plane; a hydraulic cylinder which activates the lift platform, said cylinder is inserted in the center of a pair of parallel shafts located in the upper and lower part, respectively, of the arms of the pair of scissors, said pair of scissors are located in parallel and With horizontal movement when they are activated through hydraulic traction, the scissors system is made up, at one of the ends of each arm, of a fixed articulation, in the central part, of a main shaft, at the other end of each one of the arms of the pair of scissors it is articulated through a wheel which moves on a track in horizontal plane; a base frame with tracks (altogether 4 tracks), where the wheels permit the upward and downward motion of the system through their movement on said tracks.

The hydraulic cylinder is inserted in the midpart of the pair of scissors fixed to the coupling shafts of said pair of scissors. The location of the cylinder, as well as its tilt depends on the efforts and on the stroke of the piston, which allow a maximum movement of the system against a minimum stroke.

In turn, the hydraulic cylinder is activated through an external hydraulic unit. The lift platform also includes an electronic system designed for the automatic control of the upward and downward motion of said platform.

Thus an object of the present invention is to offer a lift platform in which the system, because of its functioning principle, prevents that parts or components protrude above the platform.

A further object of the present invention is to offer a lift platform in which the space it occupies is the smallest possible because it uses folding scissors; the result is that the initial height is also lower.

A further object of the present invention is that the movement principle eliminates the use of complicated parts both in design as in functioning (transmission systems, telescopic cylinders, linear guides, etc.).

And a further object of the present invention is that the maintenance needed is very simple because the parts that form the system do not present any complexity.

BRIEF DESCRIPTION OF DRAWINGS

For a more complete understanding of the present invention, and for further details and advantages thereof, reference is now made to the following Detailed Description taken in conjunction with the accompanying drawings, in which.

DETAILED DESCRIPTION OF THE INVENTION

Figure 1:
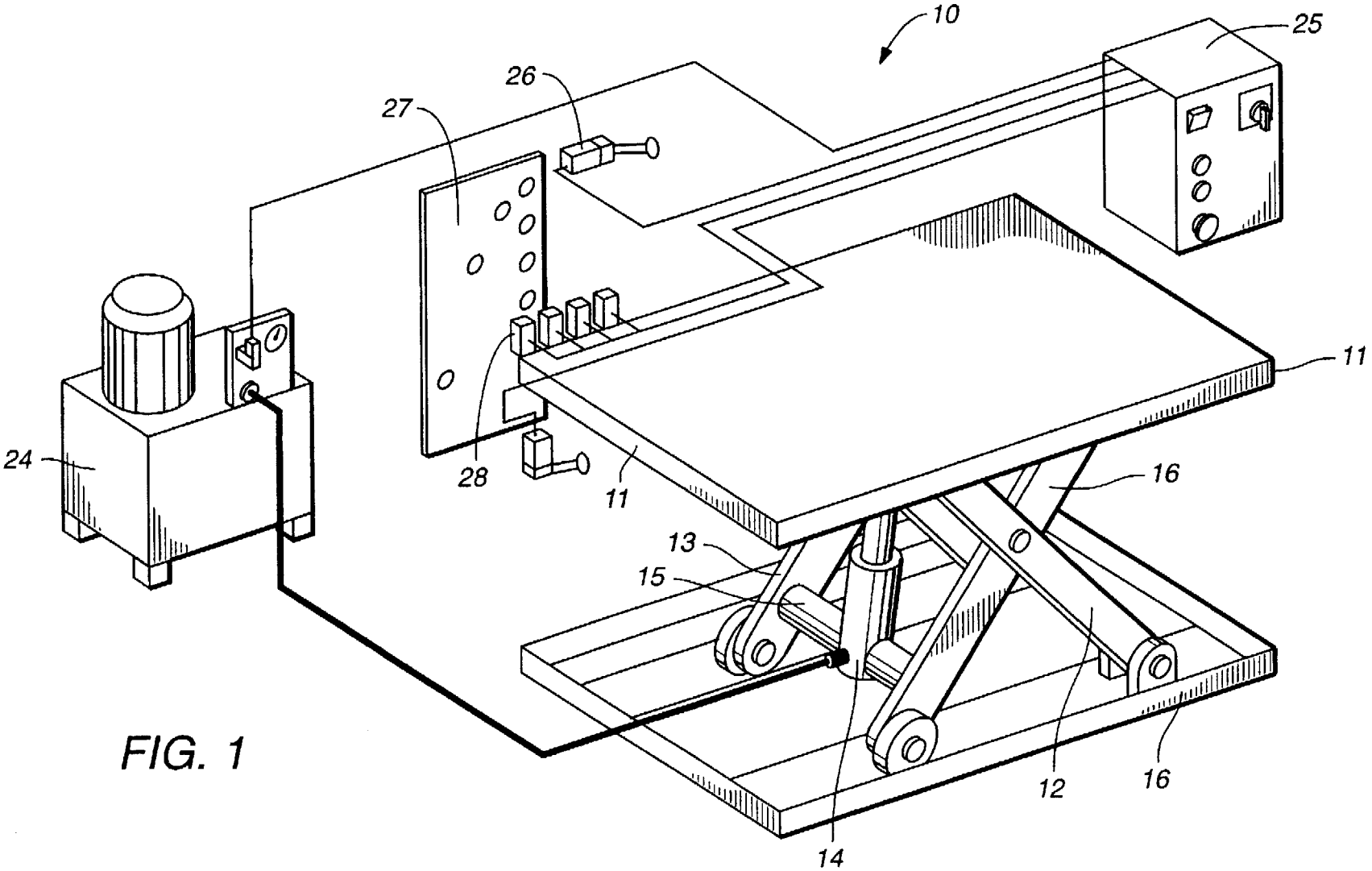
FIG. 1 is an isometric top view of the lift platform.
Figure 2:
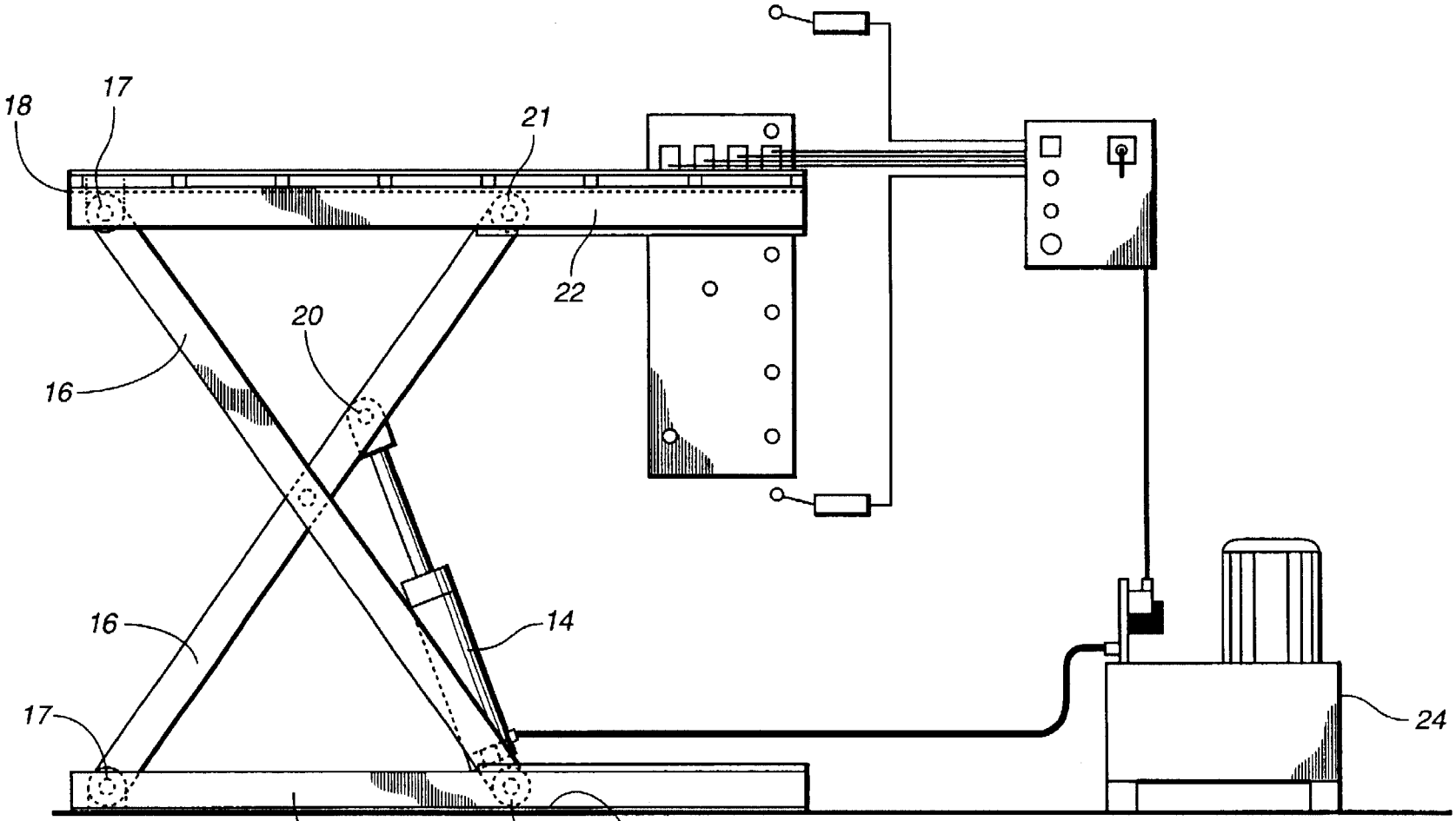
FIG. 2 is a front view of the platform of FIG. 1.

The scissors lift platform 10 is formed by the following elements, a rectangular casing 11 fixed around a frame and supported by a system of scissors 12, 13 located parallel one to the other, said system activates the upward and downward movements in a vertical plane through the insertion of a hydraulic cylinder 14 at the center of a main tubular shaft 15 which separates and joins equidistantly the lower ends of the scissors 12, 13.

The system of scissors 12, 13 is articulated through two sections, one being fixed and the other mobile. The fixed section corresponds to a part of the ends of each higher and lower arms 16, the higher arm is linked to a fixed shaft 17 which permits radial movement and in turn holds the frame 18 of the lift table 10, while the lower end of the arm 16 is linked to a fixed shaft 17 which also permits its radial movement and in turn holds the frame of the movement track 19 of the wheels 21 on the horizontal plane.

The mobile section is articulated through the other ends of the lower and upper arms 16 of the system of scissors 12, 13 and a secondary shaft 20 which equidistantly links the arms 16 of the system of scissors 12, 13 and in turn holds the hydraulic cylinder 14 in its lower part. The higher ends 16 are connected to wheels 21 which allow its movement in an horizontal plane through tracks 22 adapted in the frame of the casing of the upper part of the lift platform. Moreover, the lower ends 16 are also connected to wheels 21 of the track 23 which permit the upward and downward operation of the lift platform.

The hydraulic cylinder 14 is operated externally through a hydraulic unit 24 which is in turn controlled by an electronic system made up of an electronic control panel, limit switches 26, reflection elements 27 and optic sensors 28.

Figure 3:
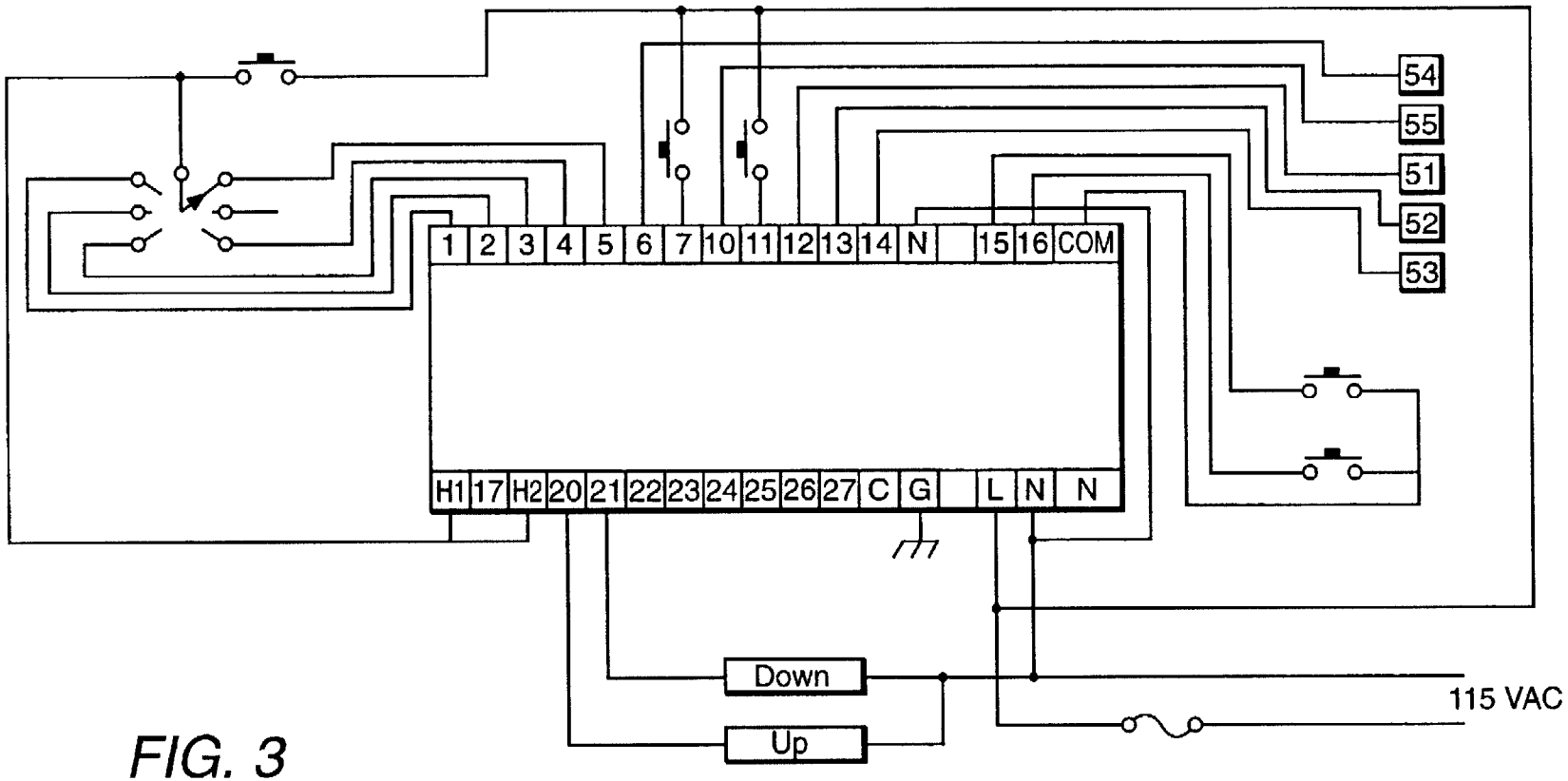
FIG. 3 is an electronic diagram of the electronic control of upward and downward motion of the lift table.

The diagram of the electronic system is described hereinbelow according to FIG. 3.

The electronic control system 25 for this lift table uses a PLC (a) SIMATIC trademark manufactured by SIEMENS, model 315AA, this PLC has 15 inlet points and 9 outlet points and can be expanded to 96 inlet/outlet points. The inlet/outlet points are 115 VAC to TRIAC, only the inlet points 15 and 16 are different in which they use 24 VDC.

The control of the system is around the PLC (a) having as inlet devices 5 optic sensors (b), two limit switches G,H, an emergency stop button (c), an upward motion button (d) (manual), a downward motion button (e) (manual), a 5 position selector (f), a program selector (I) and upward and downward motion signs on the hydraulic pump 1, K and m thermic fuse (L).

The system was designed to work according to the following table:

| SELECTOR (I) (of program) | 1 | 2 | 3 | 4 | 5 | 6 |
|---|---|---|---|---|---|---|
| SENSOR | S1 | S2 | S3 | S4 | | |
| GASKET | 6" | 15" | 21" | 30" | 42" | 0"–42" |
| AUTOMATIC | 36" | 27" | 21" | 12" | 0" | |
| | 30" | | | | | |
| | 24" | | | | | |
| | 18" | | | | | |
| | 12" | | | | | |
| | 6" | | | | | |
| | 0" | | | | | |
| MANUAL | | | | | | 0"–42" |

As can be seen in the previous table, the control can work in six different ways, according to the location of the program selector (I) for the type of gasket, hereinbelow each one of them is explained.

PROGRAM 1

When the selector is located at the position 1, the control is configured for 6" gaskets, and the optic sensor S1 (b) shall be used to position the table.

The operation of this routine is automatic and begins when pushing the upward motion button (H), when doing so the table shall lower itself till it reaches the lower limit (H) established by the limit switch 26.

Then the gasket is introduced and the upward motion button is pushed (d) at that moment the table goes up to find the 36" position indicated by the higher limit switch (G), upon the filling up of the gasket, the upper motion button is pressed again (d) and thus the table shall lower itself to the 30" position. The previous operation is carried out till reaching 0", when getting to this point the pile of gaskets shall be removed and when the button is pushed again the table shall go up again till 36" repeating the operation.

PROGRAM 2

When the selector (I) is in the position 2, the control configures itself for the 27" gaskets, and the optic sensor S2 (b) is used to position the table.

The routine begins when the upward motion button is pushed (d), when doing so the table shall lower itself till it reaches the lower limit (H), if the button is pushed again, the table shall go up to 27", when the gasket is filled and the button is pushed, the table shall lower itself to 0" where the gasket shall be removed, the routine shall be resumed when pushing the button.

The programs 3 and 4 are functioning in the same way as program 2, and the only thing to change is the optic sensor S2 (b) for the optic sensors S3 or S4, according to the programming of the control with the program selector (see previous table).

PROGRAM 5

In this program, the table shall be fixed in the 0" position. If, when selecting the program 5, the table is in any position different from 0", it is sufficient to press the upper motion button in order to lower the table, and to keep it in this position till all the programs are selected.

PROGRAM 6

In this program, the table shall be manually controlled, and, contrary to the 5 previous programs, two buttons shall be used, one to move the table upward and the other to move it downward.

PROTECTIONS

In operation, the table was protected against operator mistakes, said mistakes can be generated when introducing erroneously a (b) gasket on the table, if this is the case, the optic sensor S5 (b) shall intervene, sending a signal to PLC (a) in order to stop the movement of the table, this if the emergency stop (c) was not pushed.

If the emergency stop (c) is activated, the table shall lower itself and stop moving after the emergency stop unactivation, in order to continue the operation, the upward motion button shall be pushed (d) (in automatic form), in this way the table shall lower itself to find the position 0" and thus to be in a position to change the wrong gasket. Moreover, if the optic sensor (b) is activated, the table shall stop in order to check the error. Then, the upward motion button (d) shall be pushed and the table shall lower itself at 0" in order to remove the gasket if it was the wrong one, or if another program is selected.

OPTIC SENSORS

The optic sensors (b) are important for the control of the position of the table, through them the stop order is given in each one of the fixed positions, that is to say, an optic sensor is used for each one of the 4 first programs, and with these the positions where the table shall stop are determined.

The optic sensors used are of the REFLEX type and, in order to operate, require a reflector to dose the light loop, this characteristic was used for the control of the table. As above mentioned, the table shall stop when the sensor Sn of the program Pn locates one of the reflectors, that is why a reflector arrangement was organized as the one presented in the following table:

| PROGRAM | P1 | P2 | P3 | P4 |
|---|---|---|---|---|
| SENSOR | S1 | S2 | S3 | S4 |
| | 42" ---------- | | | |
| | 36" ----------X(UPPER LIMIT) | | | |
| | 30" ---*---------- | | | |
| | 27" ----------*---------- | | | |
| POSITIONS | 24" ---*---------- | | | |
| | 21" ----------*------ | | | |
| | 18" ---*---------- | | | |
| | 12" ---*----------*--- | | | |
| | 6" ---*---------- | | | |
| | 0" ----------X(LOWER LIMIT) | | | |

This reflector codification was arranged on a metal plate. The plate was fixed with regard to the table. The 4 optic sensors were located on the table, in front of the plate, as can be seen in the previous ruble and in FIG. 1.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

We claim:

1. A scissors lift platform with electronic control comprising:

(a) a rectangular flat casing fixed to a frame structure;

(b) a scissors system which sustains said casing in which the system is formed by a pair of scissor arms located in a parallel vertical position, coupled through a main shaft and a secondary shaft;

(c) a hydraulic cylinder coupled at a lower end of the scissors system to the center of said main shaft and in turn linked through an upper end of the scissors system to the center of the secondary shaft, providing for the upward and downward motion of the platform;

(d) a track base which offers a maximum movement of the scissors system wherein a double scissors system includes respectively two arms for each said scissors system, in such a way that two of its upper and lower ends are fixed to the frame structure while the other two are mobile through the connection of wheels at the ends of their arms which allow the horizontal movement to displace the platform in a vertical plane till the desired height; and (e) an electronic system which activates the hydraulic cylinder through an external hydraulic unit and is also activated when the electronic control panel is activated upon receiving signals from optic sensors located at one of the ends of the casing of the platform.

2. The scissors lift platform of claim 1 wherein each arm of the pair of scissors includes a fixed end and a mobile end, the mobile end supplying the desired movement, each pair of scissors having a wheel connected to an upper part of a first scissors arm and a lower part of the first scissors arm connected to the frame structure; and a wheel connected to a lower part of a second scissors arm and the second scissors arm upper part connected to the frame structure, the wheels being movable along respective tracks.

3. The scissors lift platform of claim 1 wherein the lift platform operates automatically at the desired height through an electronic system made up of an electronic control panel, a series of optic sensors located at each one of the ends of the casing of the platform and in front of a panel of reflecting elements, and a pair of upper and lower limit switches.

* * * * *